United States Patent [19]

Mammino et al.

[11] 4,052,207

[45] Oct. 4, 1977

[54] ELECTROSTATOGRAPHIC IMAGING PROCESS

[75] Inventors: Joseph Mammino, Penfield; Franklin Jossel, Rochester, both of N.Y.

[73] Assignee: Xerox Corporation, Stamford, Conn.

[21] Appl. No.: 746,359

[22] Filed: Dec. 1, 1976

Related U.S. Application Data

[62] Division of Ser. No. 599,800, July 28, 1975.

[51] Int. Cl.[2] ..... G03G 5/12; G03G 13/01

[52] U.S. Cl. ..... 96/1.2

[58] Field of Search ..... 96/1 R, 1.2; 252/62.1 R

[56] References Cited

U.S. PATENT DOCUMENTS

| | | | |
|---|---|---|---|
| 3,212,887 | 10/1965 | Miller et al. | 96/1.2 |
| 3,345,293 | 10/1967 | Bartoszewicz et al. | 96/1.2 |

*Primary Examiner*—David Klein
*Assistant Examiner*—John L. Goodrow
*Attorney, Agent, or Firm*—J. J. Ralabate

[57] ABSTRACT

A novel yellow electrostatographic colorant is disclosed. This colorant may be employed as an electrostatographic toner or developer material. Electrophotographic processes are disclosed employing this colorant. When employed as an electrophotographic developing material, this colorant is found to possess superior triboelectric properties among others which result in superior electrophotographic machine life than known yellow colorants.

19 Claims, No Drawings

ELECTROSTATOGRAPHIC IMAGING PROCESS

This is a division of application Ser. No. 599,800, filed 7/28/75.

BACKGROUND OF THE INVENTION

This invention relates to imaging systems, and more particularly, to improved xerographic developing materials, their manufacture, and use.

Electrostatography, that branch of the imaging art which relates to the formation and utilization of latent electrostatic charge patterns to record and reproduce patterns in visible form is well known in the art. When a photoconductor is employed to form these electrostatic latent images by first charging and then selectively exposing the photoconductive layer, this imaging method is referred to as electrophotography and more commonly known as xerography, the basic techniques of which are disclosed in U.S. Pat. No. 2,297,691. The latent electrostatic images thus formed may be developed or rendered visible by deposition of a finely divided electroscopic material referred to in the art as toner. The image thus obtained may be utilized in a number of ways, for example, the image may be fused or fixed in place or transferred and then fixed to a second surface.

Electrography, the other broad general branch of electrostatography, generally divided into two broad sectors which are referred to as xeroprinting and electrographic or TESI recording, does not employ a photoresponsive medium, the charging and selective discharging thereof to form its latent electrostatic image. Xeroprinting, the electrostatic analog of ordinary printing is more fully described in U.S. Pat. No. 2,576,047 to Schaffert. TESI imaging or transfer of electrostatic images, more fully described in U.S. Pat. No. 2,285,814, involves the formation of an electrostatic charge pattern conforming to a desired reproduction on a uniform insulating layer by means of an electrical discharge between two or more electrodes on opposite sides of the insulating medium. The lines of force generated by the latent electrostatic image are employed to control the deposition of the toner material to form an image. Various developers both powder and liquid and developing systems are well known to those skilled in the art including cascade development as disclosed in U.S. Pat. No. 2,618,552 to E. N. Wise; magnetic brush development as generally described in U.S. Pat. No. 2,874,063; powder cloud development as generally described in U.S. Pat. No. 2,784,109; touchdown development described in U.S. Pat. No. 3,166,432; and liquid development as described in U.S. Pat. No. 2,877,133 among others. These development systems, though they enjoy widespread use for black and white reproductions may also be employed in other colors and combinations of colors for example, a trichromatic color system of either the additive or subtractive color formation types. In full color systems at least three different colors must be employed to synthesize any other desired color which involves generally the formation of at least three color separation images and their combination in registration with each other to form a color reproduction of the original. Thus, in any of the electrostatographic recording systems at least three different latent electrostatic images must be formed, developed with different color toners and combined to form the final image. For example, in color xerography an electrostatic latent image resulting from exposure to a first primary color may be formed on the photoconductive layer and developed with a toner complementary to the primary color. In a similar fashion, succeeding developments of electrostatic latent images corresponding to primary colors are accomplished with complementary toners. When exposing through color separation negatives, the toner is the complement of the radiation of exposure.

In a three color electrophotographic system which employs superimposed color images it is necessary that the toners be quite transparent except for the underlying one so as not to obscure the different colored toner images below it and that each toner have sufficient color saturation at the same time and brightness to satisfy the colorimetric requirements for three color synthesis of natural color images. As can be appreciated, these requirements are virtually diametrically opposed and are further complicated by the additional requirement that when all the toners are combined, they must produce a deep black. It has been found that in order to produce deep blacks in a color system it is required to superpose four different colored images including a black registered image. Additional problems generally arise when inorganic pigments are used as the coloring material either in printing inks or electrophotographic toners since it is difficult to achieve proper color balance and saturation while at the same time keeping the colors transparent. When employing inorganic pigments, the range of colors available is relatively narrow and these pigments are found to impart opacity to the materials to which they are added even in relatively small amounts.

Bartoszewicz et al in U.S. Pat. No. 3,345,293 teaches colored electrophotographic toners comprising substantially transparent resin particles containing organic dye pigments. These materials are stated to be advantageous in their use over prior art materials in that they are more resistant to bleeding of color upon toner fusing and they are specifically adaptable for use in three color electrophotographic processes since their colors are yellow, cyan, magenta and their mixtures in pairs produce blue, red and green while the three toners together produce a black. Notwithstanding the apparent advantages of the Bartoszewicz et al toners, there are nevertheless disadvantages connected with these specific toners, specifically in the case of the yellow toner when employed in an automatic electrophotographic machine. The yellow colorant as advanced by Bartoszewicz et al consists essentially of from about 0.92 to about 1.08 parts by weight of 3,3'-dichloro, 4'-bis (2''-acetyl-2''-azo-o-acetotoluidide)biphenyl per 10 parts by weight of a substantially transparent resin. The problem in employing this colorant resides in its inability to disperse substantially uniformly in transparent resin materials and more significantly the undersirable triboelectric properties which result from its use causing poor images of low contrast and low machine life. It is found that the triboelectric properties of the resulting toner material are not maintained under conditions where the toner is exposed to mechanical abrasion, high temperatures, and high ambient humidity conditions, all of which are common in electrophotographic machines. This results in a number of problems including poor transfers from the drum surface to the copy sheet as well as maintaining cleanliness of the drum. More specifically, it is found that in electrophotographic machine use this toner impacts on its carrier further degrading the already existing undesirable triboelectric relationship and thereby adversely effecting machine performance.

SUMMARY OF THE INVENTION

It is, therefore, an object of this invention to provide a yellow toner material which overcomes the above-noted disadvantages.

Another object of this invention is to provide a yellow colorant to be used in combination with a resin material as a toner for use in color imaging.

Still another object of this invention is to provide a novel electrostatographic yellow toner.

Yet another object of this invention is to provide a novel transparent yellow toner.

Yet still another object of this invention is to provide a novel transparent yellow toner which may be employed in a trichromatic color synthesis of either the additive or subtractive color formation types.

Again, another object of this invention is to provide a novel electrophotographic developer.

Yet still another object of this invention is to provide a novel yellow toner material which possesses superior triboelectric properties and results in superior reproduction and long machine life.

Again, another object of this invention is to provide a novel yellow toner wherein the yellow colorant disperses substantially uniformly in a resin material.

It is still another object of this invention to provide a yellow toner which maintains its triboelectric properties under conditions of continuous use in an automatic electrophotographic imaging device.

Still another object of this invention is to provide a novel yellow toner which transfers easily and practically completely from a drum surface to a copy sheet.

A further object of this invention is to provide a relatively pure yellow toner of a desirable shade and tone.

Yet still another object of this invention is to provide a novel yellow toner for use in connection with the production of transparencies.

A still further object of this invention is to provide an electrophotographic process employing a novel yellow toner.

These and other objects are accomplished generally speaking by providing a novel yellow toner comprising a yellow colorant and a resin material or materials, said colorant comprising a compound the formation of which is generally described in U.S. Pat. No. 2,644,814, the compound satisfying the formula:

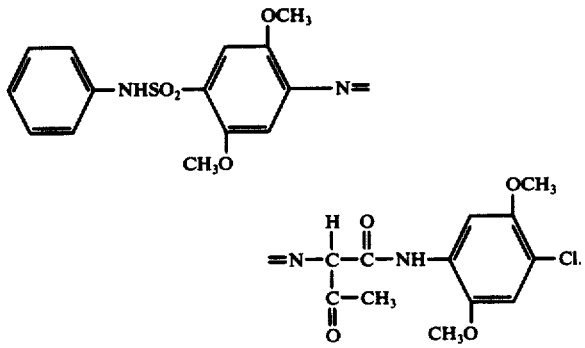

is the colorant in the toner of the invention.

This pigment classified in the Colour Index as Pigment Yellow 97 is combined with an appropriate electrophotographic resin, for example, a styrene-n-butylmethacrylate resin to form a toner and then combined with a conventional carrier, for example, methyl terpolymer coated steel carrier to provide a highly desirable yellow developer for use in color electrophotography. These are hereinafter referred to as Yellow 97 developers and Yellow 97 toners and are distinctly different and superior to those yellow colorants taught by Bartoszewicz et al and other conventional yellow developers since they are found to be transparent while other known colorants are opaque. These developers unlike other yellow developers are readily dispersible in electrostatographic resins. The most significant property of these developers, however, is their superior triboelectric properties or tribo which allow these developers to be employed very successfully in electrophotographic developing applications. When employed in an automatic electrophotographic imaging device where developer is employed, it is found that the machine tends to impact the toner and the carrier for both prior art yellow colorants and Yellow 97 colorants, however, where as in the case of prior art yellow colorants the triboelectric property tends to degrade and consequently machine performance is severely curtailed Yellow 97 developers maintain their triboelectric properties and in some cases have been found to improve upon continued impaction, thus providing superior machine life and performance.

It has been found that upon continuous use in a conventional automatic electrophotographic imaging device, for example, a Xerox 720 Copier under controlled conditions that a benzidine yellow toner as taught by Bartoszewicz et al displayed a machine life of 1400 prints, two conventionally employed black toners have useful lives of 4200 and 9000 prints whereas a Yellow 97 toner composition exhibited a useful life in excess of 25,000 prints with no apparent adverse effects. It is, therefore, demonstrated that prior art colorants including the yellow colorant of Bartoszewicz et al when combined with suitable resins to optimize their respective performances and employed in the same machine under identical conditions do not in any way begin to compare with the useful life and performance of the toner compositions of the instant invention. Further upon extended use in machine testing, conventional black toners tend to drop triboelectrically in steps until they reach a final failure level after which imaging is difficult if not impossible. These steps are not evident in prior art yellow toner life studies such as the Bartoszewicz et al yellow toner, since these toners exhibit a steady and extreme drop in tribo resulting in shortened machine life and poor machine performance. Yellow 97 toner compositions much the same as diarylide yellow compositions exhibit very stable tribo values within a well defined range with acceptable copy quality and operational characteristics over a test run of over 25,000 prints. In addition, the impaction rating exhibited by this yellow toner and a developer is actually less than generated by conventionally employed black developers over an equilvalent test period. From the table below, Table I, developer compositions employing Yellow 97 colorants, it can be seen that developer compositions employing Yellow 97 colorants are capable of achieving at least 25,000 print cycles of acceptable copy quality and development characteristics. Impaction was not found to be a problem so that this parameter is not at all reported. In addition, it may seem that Yellow 97 pigment itself when employed as recited above exhibits high triboelectric characteristics far superior to those found in the prior art as may be seen by the following table.

TABLE I

| | Prints | Toner Conc. (%) | Tribo (μc/gm) | Tribo Product | Density | Background Average |
|---|---|---|---|---|---|---|
| | TONER OF EXAMPLE I Carrier-Methylterpolymer coated steel beads, 100 μ particle size | | | | | |
| About 14% RH | Initial | 2.77 | 11.63 | 32.22 | .97 | .010 |
| | 500 | 3.21 | 11.66 | 37.42 | .65 | .010 |
| | 1.0K | 3.78 | 11.07 | 41.84 | .81 | .010 |
| | 1.5K | 4.15 | 10.89 | 45.19 | .91 | .010 |
| | 2.0K | 4.43 | 10.43 | 46.23 | .89 | .010 |
| | 2.5K | 4.38 | 10.19 | 44.63 | .90 | .010 |
| | 3.0K | 4.24 | 11.24 | 47.68 | .90 | .010 |
| | 3.5K | 4.55 | 10.55 | 48.01 | 1.00 | .010 |
| | 4.0K | 4.08 | 11.20 | 45.68 | .86 | .010 |
| | 4.5K | 4.19 | 11.38 | 47.68 | .90 | .010 |
| | 5.0K | 4.49 | 9.85 | 44.22 | 1.00 | .010 |
| | 5.5K | 4.17 | 11.14 | 46.47 | .75 | .010 |
| | 6.0K | 4.18 | 11.72 | 48.99 | .72 | .010 |
| | 6.5K | 4.07 | 11.93 | 48.56 | .82 | .010 |
| 80% RH | Initial | | | | | |
| | 6.5K | 2.99 | 8.44 | 25.24 | 1.06 | .010 |
| | 7.0K | 2.41 | 9.78 | 23.57 | .72 | .010 |
| | 7.5K | 2.40 | 9.45 | 22.68 | .75 | .010 |
| | 8.0K | 2.26 | 10.16 | 22.97 | .87 | .010 |
| | 8.5K | 2.52 | 9.65 | 24.31 | 1.06 | .010 |
| | 9.0K | 2.36 | 10.16 | 23.98 | .90 | .010 |
| | 9.5K | 2.94 | 8.72 | 25.63 | 1.18 | .010 |
| | 10.0K | 2.89 | 7.76 | 22.43 | 1.29 | .010 |
| | 10.5K | 2.11 | 8.72 | 18.39 | 1.04 | .010 |
| | 11.0K | 1.66 | 11.11 | 18.44 | .55 | .010 |
| | 11.5K | 2.12 | 8.54 | 18.11 | 1.04 | .010 |
| | 12.0K | 1.82 | 9.97 | 18.15 | .80 | .010 |
| | 12.5K | 1.70 | 7.11 | 12.08 | 1.06 | .010 |
| 20% RH | 13.0K | 2.20 | 7.98 | 17.56 | 1.14 | .010 |
| | 13.5K | 2.38 | 8.46 | 20.84 | .97 | .010 |
| | 14.0K | 2.43 | 8.67 | 21.07 | .94 | .010 |
| | 14.5K | 2.40 | 9.09 | 21.82 | .95 | .010 |
| | 15.0K | 2.64 | 8.73 | 23.04 | .98 | .010 |
| | 15.5K | 2.74 | 8.54 | 23.40 | .99 | .010 |
| | 16.0K | 2.90 | 10.65 | 30.87 | .84 | .010 |
| | 16.5K | 2.89 | 11.26 | 32.54 | .82 | .010 |
| | 17.0K | 2.80 | 10.99 | 30.77 | .62 | .010 |
| | 17.5K | 3.11 | 9.95 | 30.87 | .94 | .010 |
| | 18.0K | 2.92 | 10.98 | 32.05 | .90 | .010 |
| | 18.5K | 2.90 | 11.07 | 32.09 | .80 | .010 |
| | 19.0K | 2.93 | 12.02 | 35.22 | .71 | .010 |
| | 19.5K | 2.98 | 11.46 | 34.16 | .67 | .010 |
| | 20.0K | 2.81 | 12.23 | 34.36 | .81 | .030 |
| | 20.5K | 3.03 | 12.01 | 36.36 | .83 | .030 |
| | 21.0K | 3.08 | 11.84 | 36.46 | .84 | .020 |
| | 21.5K | 2.90 | 10.87 | 31.52 | .82 | .025 |
| | 22.0K | 2.55 | 11.90 | 30.36 | .51 | .010 |
| | 22.5K | 2.60 | 11.60 | 30.16 | .81 | .010 |
| | 23.0K | 2.65 | 10.36 | 27.46 | .89 | .010 |
| | 23.5K | 2.59 | 10.22 | 26.47 | .80 | .010 |
| | 24.0K | 2.65 | 9.44 | 25.01 | .80 | .010 |
| | 24.5K | 2.51 | 10.78 | 25.29 | .64 | .010 |
| | 25.0K | 2.51 | 10.27 | 25.78 | .77 | .010 |

Structurally, the Yellow 97 colorants satisfying the following formula:

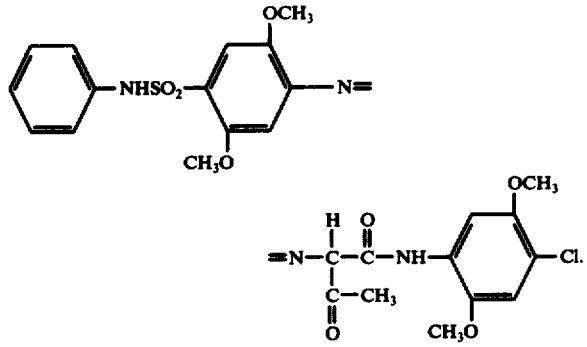

differs from the diarylide yellow colorants listed in the Colour Index as C.I. No. 21090 Pigment Yellow 12 and disclosed in U.S. Ser. No. 197,943, filed Nov. 11, 1971, satisfying the formula:

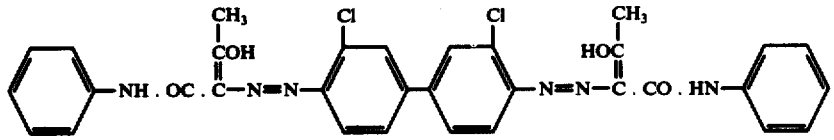

and from the benzidine yellow colorants as disclosed by Bartoszewicz et al listed in the Colour Index as C.I. No. 21095 Pigment Yellow 14 and satisfying the following formula:

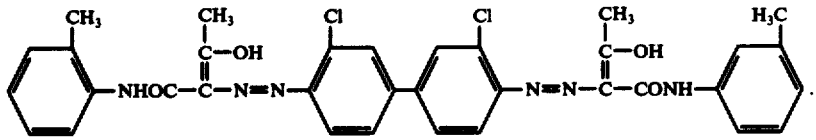

Any suitable resin material may be used for the toner compositions of the present invention. As previously stated, substantially transparent resins are preferred when the toner is to be used in a three color electrophotographic system. Although any substantially transparent resin material may be utilized as the resin component of this toner, it is preferable that resins having other desirable properties be utilized in this invention. Thus, for example, it is desirable that a resin be used which is a non-tacky solid at room temperature so as to facilitate handling and use in the most common electrophotographic processes. Thermal plastics are desirable with melting points significantly above room temperature, but below that of which ordinary paper tends to char so that once the toner images form thereon or transfer to a paper copy sheet it may be employed and fixed to paper copy sheets by other techniques, such as, subjecting the paper copy sheet bearing the powder image to vapors of a solvent for the resin as generally described in U.S. Pat. No. 2,776,907. The resins selected should desirably have good triboelectric properties and have sufficient insulating properties to hold charge so that they may be employed in a number of development systems.

While any suitable transparent resin possessing the properties as above described may be employed in the system of the present invention, particularly good results are obtained with the use of vinyl resins and polymeric esterification products of a dicarboxylic acid and a diol comprising a diphenol. Any suitable vinyl resin may be employed in the toners of the present system including homopolymers or copolymers of two or more vinyl monomers. Typical such vinyl monomeric units include: styrene; p-chlorostyrene; vinyl naphthalene; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good triboelectric stability and uniform resistance against physical degradation. However, non-vinyl type thermoplastic resins may also be employed including rosin modified phenol formaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

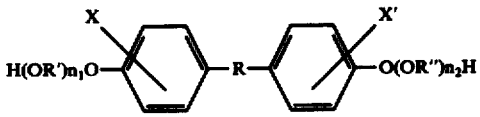

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms, and arylene radicals; X and X' represent hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such dipenols include: 2,2-bis(4-beta hydroxyl ethoxy phenyl)-propane, 2,2-bis(4-hydroxy isopropoxy pheny) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxyl-ethoxy-phenyl) -butane, 1,1-bis(4-hydroxyl isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis (4-beta hydroxy ethoxy phenyl)-norbornane, 2,2'-bis(4beta hydroxy ethoxy phenyl) norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n_3}\ COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: rosin modified phenol formaldehyde resins, oil modified epoxy resins, polycarbonate, polysulfone, polyphenylene oxide, polyurethane resins, cellulosic resins, vinyl type resins and mixtures thereof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique such as hot melt, solvent, and emulsion techniques may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Preferred electrophotographic results with the Yellow 97 colorant of the instant invention are achieved with styrene-butyl methacrylate copolymers, styrene-vinyl-toluene copolymers, styrene-acrylate copolymers, polystyrene resins, predominantly styrene or polystyrene based resins as generally described in U.S. Pat. No. Re. 25,136 to Carlson, and polystyrene blends as described in U.S. Pat. No. 2,788,288 to Rheinfrank and Jones. Optimum results are achieved with the Yellow 97 of the invention and styrene-n-butylmethacrylate copolymer resins to form a toner of long life and low impaction.

Any well known toner mixing and comminution technique may be employed to provide the toner compositions of the instant invention. For example, the ingredients may be thoroughly mixed by blending, extrusion and milling and thereafter micropulverized. In addition, spray drying a suspension of the ingredients, a hot melt or a solution of the toner composition may also be employed.

The toners of the invention may be any size which will result in a satisfactorily developed image. Toners of the invention suitable for use with a carrier in cascade or magnetic development generally have an average particle size of about 5 microns to about 45 microns. A preferred average particle size range is about 10 microns to about 20 microns to result in a print of maximum density.

Where carrier materials are employed in connection with the toner compositions of the instant invention in cascade and magnetic brush development, the carrier particles employed may be electrically conductive, insulating, magnetic or non-magnetic, as long as the carrier particles are capable of triboelectrically obtaining a charge of opposite polarity to that of the toner particles so that the toner particles adhere to and surround the carrier particles. In developing a positive reproduction of an electrostatic image, the carrier particle is selected so that the toner particles acquire a charge having a polarity opposite to that of the electrostatic latent image so that toner deposition occurs in image areas. Alternatively, in reversal reproduction of an electrostatic latent image, the carriers are selected so that the toner particles acquire a charge having the same polarity as that of the electrostatic latent image resulting in toner deposition in the non-image areas. Typical carrier materials include: sodium chloride, ammonium chloride, aluminum potassium chloride, Rochelle salt, sodium nitrate, aluminum nitrate, potassium chlorate, granular zircon, granular silicon, methyl methacrylate, glass, steel, nickel, iron, ferrites, ferromagnetic materials, silicon dioxide and the like. The carriers may be employed with or without a coating. Many of the foregoing and typical carriers are described by L. E. Walkup in U.S. Pat. No. 2,618,551; L. E. Walkup et al in U.S. Pat. No. 2,638,416; E. N. Wise in U.S. Pat. No. 2,618,552; R. H. Hagenbach et al in U.S. Pat. No. 3,591,503 and 3,533,835 directed to electrically conductive carrier coatings, and B. J. Jacknow et al in U.S. Pat. No. 3,526,533 directed to polymer coated carriers and nodular carriers having pebbled surface as disclosed in Ser. No. 357,988, filed May 7, 1973, now U.S. Pat. No. 3,847,604, a divisional of Ser. No. 151,995, filed June 10, 1971, now U.S. Pat. No. 3,767,568. An ultimate coated carrier particle diameter between about 50 microns to about 1,000 microns is suitable because the carrier particles then possess sufficient density and inertia to avoid adherence to the electrostatic images during the cascade development process. A preferred particle size is between about 75 and 400 microns. Optimum performance with the toner of the instant invention is about 100 microns for best density images and long life. The carrier may be employed with the toner composition in any suitable combination, generally satisfactory results have been obtained when about 1 part toner is used with about 10 to about 200 parts by weight of carrier.

Terpolymer carriers which are disclosed in U.S. Pat. No. 3,526,533 are suitable for use with the toner of the instant invention. The terpolymer coated carriers comprise a core coated with a composition which is formed from the addition polymerization reaction between monomers or prepolymers of styrene, methylmethacrylate and unsaturated organo silanes, silanols or siloxanes having from 1 to 3 hydrolyzable groups and an organic group attached directly to the silicon atom containing an unsaturated carbon to carbon linkage capable of addition polymerization. Preferred with the toner of the instant invention is a steel carrier core coated with the composition of Example XIII of U.S. Pat. No. 3,526,533 to form a methyl terpolymer carrier which provides a developer composition which results in good density coverage and long life.

The optimum carriers for use with toner compositions of the instant invention are those of nickel berry. Nickel berry carriers are a member of a group of nodular carrier beads disclosed in U.S. Pat. Nos. 3,847,604 and 3,767,568, characterized by a pebbled surface with recurring recesses and protrusions giving the particles a relatively large external surface area and composed of nickel. Such nodular carrier beads have high surface-to-mass ratio as compared with substantially smooth-surfaced carrier beads of the same mass. Using the nodular carrier materials, one can obtain the benefits of both large and small carrier beads while avoiding their shortcomings. Nodular carrier particles present a plurality of small spherical surfaces with recesses defining pockets for toner particles. The nickel berry carrier when used with the toner of the instant invention results in excellent density coverage and exceptionally long life.

The nodular carrier beads are three dimensional solids approximately 50 to 1,000 microns in size of roughly berry, cuboidal, rounded, irregular or spheroidal shape, and with surface irregularities formed by numerous nodules and recesses. Though the beads may have randomly spaced voids or a slight degree of porosity, they should have predominantly solid cores. Preferred carrier beads have generally rounded nodules and are generally spheroidal in shape thus giving an appearance reminiscent of a raspberry or cluster of grapes.

The electrostatic latent images developed by the toner compositions of the instant invention may reside on any surface capable of retaining charge. In electrophotographic applications a photoconductive member is employed to form the electrostatic latent image. The photoconductive layer may comprise an inorganic or an organic photoconductive material. Typical inorganic materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antomony trisulfide, cadmium sulfoselenide and mixtures thereof. Typical organic photoconductors include: triphenylamine; 2,4-bis(4,4'-diethylaminophenol)-1,3,4 -oxidiazol; N-isopropylcarbazole; triphenylpyrrol; 4,5 -diphenylimidazolidione; 4,5-diphenylimidazolidinethione; 4,5-bis-(4'-amino-phenyl)-imidazolidinone; 1,5-dicyanonaphthalene; 1,4-dicyanonaphthalene; aminophthalodinitrile; nitrophthalodinitrile; 1,2,5,6-tetraazacyclooctatetraene-(2,4,6,8); 2-mercaptobenzothiazole-2-phenyl-4-diphenylidene-oxazolone; 6-hydroxy-2,3-di(p-methoxyphenyl)-benzofurane; 4-dimethylamino -benzylidene-benzhydrazide; 3,-benzylidene-amino-carbazole; polyvinyl carbazole; (2-nitro-benzylidene)-p-bromo-aniline; 2,4-diphenyl-quinazoline; 1,2,4-triazine; 1,5-diphenyl-3 -methyl-pyrazoline 2-(4'-dimethyl-amino phenyl)-benzoxazole; 3-amino-carbazole; polyvinylcarbazole-trinitro-fluorenone charge transfer complex; phthalocyanines and mixtures thereof.

The toner of the instant invention is particularly suitable for use as in the yellow toner in the color electrophotographic imaging processes disclosed in U. S. Pat. No. 3,804,619 and U. S. Ser. No. 425,481, filed Dec. 17, 1973, both of which are hereby incorporated by reference. The process disclosed in the above-referenced patent specifications are multiple development techniques capable of producing color reproductions employing multiple sequencing of electrophotographic charging, exposing through filters and developing steps with three different color toners. The toners of magenta, cyan and yellow colors are developed after exposure through green, red and blue filters, respectively.

In development and transfer of the three colored toner images, it is necessary that the relationship of the toners with each be such that they cooperate to produce an image of good quality. It is apparent that any one of a number of variables could cause incomplete, improper, or inadequate development so that color balance is thereby shifted resulting in an unacceptable color print.

A use of the toners of the instant invention is for a sequential three color development process when combined with a nickel berry carrier and utilized in combination with a copper phthalocyanine pigment identified in the Colour Index as C.I. 74160, C.I. Pigment Blue 15 cyan toner and a methyl terpolymer coated steel carrier and anthraquinone dye identified in the Colour Index as C.I. 60,710, C.I. Disperse Red 15 magenta toner and a nickel berry carrier.

The toner of the instant invention has been found to be particularly suitable for a sequential three color development process when combined with a nickel berry carrier and utilized in combination with a copper tetra-4-(octadecylsulfonamido) phthalocyanine pigment available from GAF Corporation under the designation of Sudan Blue OS, cyan toner and a methyl terpolymer coated steel carrier; 2,9-dimethylquinacridone pigment identified in the Colour Index as Pigment Red 122, magenta toner and a nickel berry carrier.

A sequential color electrophotographic process is performed by charging a photoconductive member, exposing said photoconductive member to an original to be reproduced through a filter of one color thereby selectively discharging said photoconductive member, developing the electrostatic image formed thereby with a developer of a complementary color, said developer being one member of the group consisting of copper tetra-4-(octadecylsulfonamido) phthalocyanine pigment a cyan toner and a methyl terpolymer coated steel carrier; 2,9-dimethylquinacridone pigment identified in the Colour Index as C.I. Pigment Red b 122, magenta toner and a nickel berry carrier; the toner of the instant invention and a nickel berry carrier; charging said photoconductor for a second time and selectively exposing said photoconductor to the same image through a filter of another primary color, developing the latent electrostatic image formed thereby with a developer of a complementary color, said developer being another member selected from the group consisting of copper tetra-4-(octadecylsulfonamido) phthalocyanine pigment, cyan toner and a methyl terpolymer coated steel carrier; 2,9-dimethylquinacridone pigment identified in the Colour Index as C.I. Pigment Red 122, magenta toner and a nickel berry carrier; and the toner of the instant invention and a nickel berry carrier; charging said photoconductive member for a third time, exposing said photoconductor to the same image through a filter of the remaining primary color and developing the latent electrostatic image with a complementary developer, said developer being the remaining developer of the group consisting of the above copper phthalocyanine pigment, the above cyan toner and a methyl terpolymer coated steel carrier; the above C.I. Pigment Red 122, magenta toner and a nickel berry carrier; and the yellow toner of the instant invention and a nickel berry carrier.

The preferred order of development and method formation of the magenta and cyan toners is as disclosed in Example I of U.S. Ser. No. 425,481, filed Dec. 12, 1973. However, any sequence of development of the cyan, magenta and yellow toners may be used to produce satisfactory prints.

To further define the specifics of the present invention, the following examples are intended to illustrate and not limit the particulars of the present system. Parts and percentages are by weight unless otherwise indicated.

EXAMPLE I

A styrene-n-butylmethacrylate copolymeric resin is employed with Colour Index Pigment Yellow 97 colorant so that the colorant comprises three percent of the toner composition by weight. The mixture is blended in a drum tumbler for about an hour at about 10 rpm. The material is then poured into a screw feeder and extruded until machine equilibrium is established. The extruded strands are taken up at the rate of about 50 feet per minute and cooled in a water bath at about 120° F followed by forced air drying. The strands are then cut by a knife device to make pellets having a diameter in the range of from 1/16 ⅛ of an inch. These pellets are then jetted to about 15 microns average particle size. This toner is then combined with a methyl terpolymer coated steel carrier as before described, to provide an electrostatographic developer. The developer thus produced is employed in an automatic imaging device, a Xerox Model 6500 copier, having a magnetic brush development system. The selenium photoconductor is charged, selectively exposed, and developed with the yellow developer. After 25,000 prints are obtained, images continue to be produced which possess good contrast, high image density and a desirable appearance. The tribo of the developer continues to maintain a high level similar to that as obtained in Table I.

EXAMPLE II

The process as outlined in Example I is again employed with the exception that 5 percent pigment concentration is employed with favorable results.

EXAMPLE III

The process as outlined in Example I is again employed with the exception that a 7 percent pigment loading is employed with favorable results.

EXAMPLE IV

The process as outlined in Example I is again employed with the exception that a styrene resin is employed with favorable results.

EXAMPLE V

The process as outlined in Example I is again performed with the exception that the nodular nickel carrier having a pebbled surface commonly referred to as nickel berry is employed with favorable results. The nickel berry carrier is disclosed in the above-referenced U.S. Pat. Nos. 3,847,604 and 3,767,568.

EXAMPLE VI

The process as described in Example I is again performed with the exception that the yellow developer obtained is applied to a mylar transparent substrate to produce a yellow imaged transparency of good quality.

EXAMPLE VII

A yellow developer as produced in Example I is employed as the yellow developer in the trichromatic electrophotographic imaging process as described in U.S. Ser. No. 425,481, filed Dec. 12, 1973, with good results.

EXAMPLE VIII

A yellow developer as produced in Example V is employed as the yellow developer in the trichromatic electrophotographic imaging process as described in Example I of U.S. Pat. No. 3,804,619, with good results.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. An electrostatographic imaging process comprising establishing an electrostatic latent image on a surface and contacting said surface with an electrostatographic material comprising a resin material and a colorant, said colorant satisfying the formula.

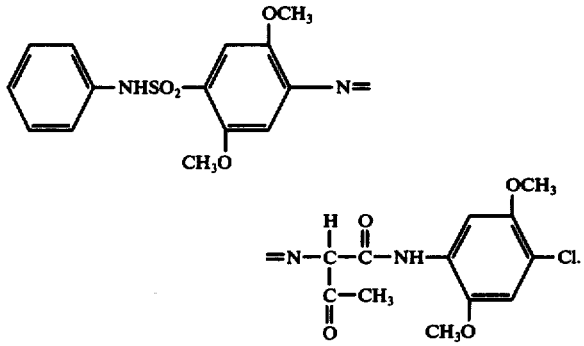

2. The imaging process as defined in claim 1 further including the steps of transferring said developed image to a receiving surface and fixing said image on said receiving surface.

3. The process as defined in claim 1 wherein said electrostatographic material further includes a methyl terpolymer coated steel carrier.

4. The material as defined in claim 1 wherein said carrier is a nickel berry carrier.

5. A color electrophotographic imaging process comprising charging a photoconductive member, exposing said photoconductive member to an original to be reproduced through a filter of one color thereby selectively discharging said photoconductive member, developing the electrostatic image formed thereby with a developer of a complementary color, said developer being one member of the group consisting of copper tetra-4-(octadecysulfonamido) phthalocyanine pigment, cyan toner and a methyl terpolymer coated steel carrier; 2,9-dimethylquinacridone pigment identified in the Colour Index as C.I. Pigment Red 122, megneta toner and a nickel berry carrier; azo dye classified in the Colour Index as Yellow Pigment 97, yellow toner and a nickel berry carrier; charging said photoconductor for a second time and selectively exposing said photoconductor to the same image through a filter of another primary color, developing the latent electrostatic image formed thereby with a developer of a complementary color, said developer being another member selected from the group consisting of copper tetra-4-(octadecylsulfonamido) phthalocyanine pigment, cyan toner and a methyl terpolymer coated steel carrier; 2,9-dimethylquinacridone pigment identified in the Colour Index as C.I. Pigment Red 122, magenta toner and a nickel berry carrier; and azo dye identified in the Colour Index as yellow 97, yellow toner and a nickel berry carrier; charging said photoconductive member for a third time, exposing said photoconductor to the same image through a filter of the remaining primary color and developing the latent electrostatic image with a complementary developer, said developer being the remaining developer of the group consisting of copper tetra-4-(octadecylsulfonamido) phthalocyanine pigment, cyan toner and a methyl terpolymer coated steel carrier; 2,9-dimethylquinacridone pigment identified in the Colour Index as C.I. Pigment Red 122, magenta toner and a nickel berry carrier; and azo dye identified in the Colour Index as Yellow Pigment 97 yellow toner, and a nickel berry carrier.

6. The method of claim 5 wherein the magenta toner is anthraquinone dye identified in the Colour Index as C.I. 60710, C.I. Disperse Red 15.

7. The method of claim 5 wherein the cyan toner is copper phthalocyanine pigment identified in the Colour Index as C.I. 74160, C.I. Pigment Blue 15.

8. The method of claim 5 wherein the magenta toner is anthraquinone dye identified in the Colour Index as C.I. 60710, C.I. Disperse Red 15 and the cyan toner is copper phthalocyanine pigment identified in the Colour Index as C.I. 74160, C.I. Pigment Blue 15.

9. An electrostatographic imaging process comprising establishing an electrostatic latent image on a surface and contacting said surface with a electrostatographic developer material comprising a carrier and a toner said toner comprising a resin material and a colorant satisfying the formula:

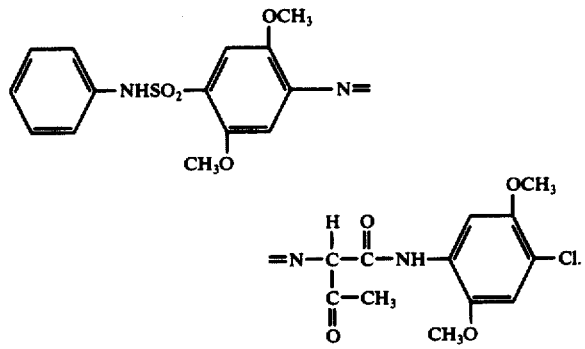

10. The process as defined in claim 9 wherein said resin is a member selected from the group consisting of styrene-butylmethacrylate copolymers, styrene-vinyltoluene copolymers, styrene-acrylate copolymers, and polystyrene resins.

11. The process as defined in claim 9 wherein said resin is a styrene-n-butylmethacrylate copolymers.

12. The process as defined in claim 9 wherein about 1 part of said toner material is present for about 10 to about 200 parts by weight of said carrier.

13. The process as defined in claim 9 wherein said carrier is a member selected from the group consisting of terpolymer coated carriers and nickel berry carriers.

14. The process as defined in claim 9 wherein said carrier is a methyl terpolymer coated steel carrier.

15. The imaging process as defined in claim 9 further including the steps of transferring said developed image to a receiving surface and fixing said image on said receiving surface.

16. The process as defined in claim 1 wherein said resin is a member selected from the group consisting of styrene-butylmethacrylate copolymers, styrene-vinyltoluene copolymers, styrene-acrylate copolymers, and polystyrene resins.

17. The process as defined in claim 1 wherein said resin in substantially transparent.

18. The process as defined in claim 1 wherein said resin comprises a polymeric esterification product of a dicarboxylic acid and a diol comprising a diphenol.

19. The process as defined in claim 1 wherein said resin is a styrene-n-butylmethacrylate copolymer.

* * * * *